US006840611B2

(12) United States Patent
Kudo et al.

(10) Patent No.: US 6,840,611 B2
(45) Date of Patent: Jan. 11, 2005

(54) RECORDING HEAD STRUCTURE PROVIDED WITH INK RESERVOIR SECTION

(75) Inventors: Kiyomitsu Kudo, Tokyo (JP); Toshihiko Ujita, Kanagawa (JP); Suguru Taniguchi, Tokyo (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 10/705,271

(22) Filed: Nov. 10, 2003

(65) Prior Publication Data

US 2004/0095446 A1 May 20, 2004

(30) Foreign Application Priority Data

Nov. 19, 2002 (JP) ..... 2002-335232

(51) Int. Cl.[7] ..... B41J 2/175
(52) U.S. Cl. ..... 347/86
(58) Field of Search ..... 347/30, 84, 85, 347/86, 87, 92

(56) References Cited

U.S. PATENT DOCUMENTS 3,953,862 A * 4/1976 Amberntsson et al. ..... 347/87
4,771,295 A * 9/1988 Baker et al. ..... 347/87
5,801,737 A * 9/1998 Sato et al. ..... 347/86
6,257,715 B1 * 7/2001 Thielman et al. ..... 347/92
6,474,797 B2 * 11/2002 Kurata et al. ..... 347/85
6,612,683 B2 * 9/2003 Takahashi et al. ..... 347/30
6,663,233 B2 * 12/2003 Otsuka et al. ..... 347/85

FOREIGN PATENT DOCUMENTS

JP 2000-334982 12/2000

* cited by examiner

*Primary Examiner*—Anh T. N. Vo
(74) *Attorney, Agent, or Firm*—Morgan & Finnegan, LLP

(57) ABSTRACT

A covering member is installed on the upper face of a liquid storing chamber, which further covers a communicating for covering a gas-liquid separation member. For the ink jet cartridge, given the length of each of paths from the gas-liquid separation member to the atmosphere communication port as Ln, and the sectional area of each path as Sn, and then, the diffusion resistance $R=\Sigma(Ln/Sn)$, and the coefficient $K=10{,}000$ ($mg.mm/mm^2$), it is arranged to set the Ln and Sn to satisfy the $K/V<R<2{,}000$, provided that the total weight of liquid filled in the liquid storing chamber is V.

1 Claim, 3 Drawing Sheets

RECORDING HEAD STRUCTURE PROVIDED WITH INK RESERVOIR SECTION

BACKGROUND OF THE INVENTION

1. Field of the Invention

The present invention relates to an ink reservoir section for reserving ink to be supplied to the recording head used in the field of ink jet recording, and a recording head structure provided with such ink reservoir section. More particularly, the recording head structure provided with an ink reservoir section preferably usable for the ink jet recording apparatus, which is mounted on the carriage of the ink jet recording apparatus together with the ink jet recording head, and which adopts the intermittent ink supply system whereby to receive ink supplies intermittently by being connected with the main ink tank as required.

2. Related Background Art

For an ink jet recording apparatus, it has been generally practiced that an ink jet recording head is mounted on the carriage, which is guided by a guide shaft, and that recording is made in a mode having the head to scan to the left and right on a recording medium.

For the ink jet recording apparatus that records by enabling the ink jet head to scan, the so-called on-carriage type has been known to record by use of the ink jet recording head provided with nozzles for discharging ink, which is formed in the cartridge form structured to be connected with the ink tank that reserves and retains ink to be supplied to the head, having the air communication section for releasing the inside thereof to the air outside, and also, being made attachable to and detachable from the carriage (the recording head and the ink tank may be structured either inseparable or separable), which is mounted on the carriage that enables the head cartridge to scan along the guide shaft for recording.

Also, there is the so-called tube supply type, in which only the ink jet recording head is mounted on a carriage, while the tank cartridge having ink retained therein is provided for the main body side, and the ink jet recording head and the tank cartridge is connected with a flexible ink supply tube for supplying ink.

However, the weight of the on-carriage type becomes heavier, because the head cartridge, which retains ink therein, is installed on the carriage, and it tends to impede the high-speed scan of the carriage. Also, if the cartridge is made smaller in order to make it lighter, the number of recordable sheets may be made smaller inevitably in some cases.

On the other hand, there are some cases where the downsizing of an apparatus may be difficult for the tube supply type because the structure becomes complicated due to the use of the ink supply tube for connecting the ink cartridge and the ink jet recording head.

Therefore, there has been proposed the intermittent ink supply method (hereinafter, may be referred to as a pit-in method for convenience' sake) in which the recording head provided with a sub-tank is installed on the carriage, and when the carriage is in the home position or in a designated position, it is connected with the main tank provided for the apparatus main body so as to supply a predetermined amount of ink to the sub-tank on the carriage as needed.

As the ink jet cartridges used for the pit-in method ink jet recording apparatus, there is the one provided with the gas-liquid separation member formed by porous material, such as PTFE (polytetra fluoroethylene), in the sub-tank, which cuts off ink and other liquid, but allows gas to permeate, as disclosed in the specification of Japanese Patent Application Laid-Open No. 2000-334982, for example. In the case of the pit-in method, the inside of the sub-tank is negatively pressurized by sucking air through the atmosphere communication port that enables the inside of the sub-tank to be communicated with the air outside, thus inducing ink into the sub-tank from the liquid supply port provided for the sub-tank. With the gas-liquid separation member positioned in a predetermined location between the sub-tank and the atmosphere communication port, there is no possibility that ink flows out from the atmosphere communication port. Also, this functions as a valve to terminate ink filling in the status where the sub-tank is fully filled with ink (hereinafter, this valve is referred to as a "full tank valve"), thus making it possible to execute ink filling easily and reliably.

In the intermittent ink supply method disclosed in the specification of Japanese Patent Application Laid-Open No. 2000-334982, the atmosphere communication port of the ink cartridge is always released to the air outside. As a result, when the ink cartridge is installed on an ink jet apparatus, ink in the tank is evaporated from the atmosphere communication port irrespective of being in use or not.

For example, the ink tank of the on-carriage type is also provided with the atmosphere communication port, and this atmosphere communication is in the status that it is always released to the air outside, thus inviting the ink evaporation. However, in order to make such ink evaporation difficult, it is structured to arrange the ink supply path that connects the inside of the ink tank and the outer opening of the atmosphere communication port thin and long to provide a large resistance to the ink dispersion, thus reducing the ink evaporation.

Here, for the intermittent ink supply method, which is in a mode to suck the inside of the sub-tank by the application of the atmosphere communication port disclosed in the specification of Japanese Patent Application Laid-Open No. 2000-334982, the resistance to suction in the atmosphere communication port is made too great when ink is supplied to the sub-tank if the structure of the atmosphere communication port, which has a large resistance to the ink dispersion as arranged for the ink tank of on-carriage type, is adopted. As a result, it becomes impossible to supply ink into the sub-tank at high speed eventually. If such is a case, the advantages that may be brought about by the adoption of the intermittent ink supply method cannot be demonstrated. In the case of the intermittent ink supply method, therefore, it is adopted to form the structure so that resistance is made smaller in the range from the inside of the sub-tank to the atmosphere communication port for the easier suction, and the high-speed ink supply operation as well.

Consequently, it becomes inevitable that the structure tends to be such as to make the ink evaporation easier from the atmosphere communication port. As the ink evaporation advances in the sub-tank, that is, as the moisture component of ink and the solvent component are evaporated, ink becomes the one having high concentration of dyestuffs, which is the composition of ink, resulting in the images having higher density than originally anticipated, and the quality thereof is degraded. Also, if the ink evaporation further advances, ink around the nozzle portion becomes overly viscous or the dyestuffs are solidified around the nozzle portion, and ink in the nozzle portion cannot be refreshed even by the execution of the suction recovery operation. Consequently, there occurs twisted discharge direction or disabled discharges. In some cases, the discharge characteristics are deteriorated eventually.

When the apparatus is not in use, the atmosphere communication port is capped and kept in the airtight condition, hence making it possible to suppress the ink evaporation in the sub-tank. It is inevitable, then, that means is lost for easing the influence that may be exerted by the expansion and contraction of the air in the sub-tank due to the environmental changes, which may cause the temperature to change. There is a fear that the problem is encountered that ink leaks from the nozzle portion or the liquid supply port or the in-take of the air occurs in the nozzle portion or the liquid supply port, among some others. Therefore, this structure is far from being adoptable.

SUMMARY OF THE INVENTION

Now, with a view to solving the problems discussed above, the present invention is designed. It is an object of the invention to provide a recording head structure provided with a reservoir section capable of supplying ink quickly at high speed without generating the slow down of ink supply speed, while reducing the degradation of image quality, and the deterioration of discharge characteristics by suppressing the amount of ink evaporation from the atmosphere communication port for the ink jet cartridge that adopts the pit-in ink supply method utilizing the gas-liquid separation member as a full tank valve.

In order to achieve the aforesaid object, the recording head structure of the present invention, which is provided with an ink reservoir section, comprises a recording head provided with a liquid discharge port for discharging liquid; at least one liquid storing chamber for storing liquid to be supplied to the recording head; a gas-liquid separation member arranged for an opening portion of the liquid storing chamber; and an atmosphere communication port for enabling the inside of the liquid storing chamber to be communicated with the air outside through the gas-liquid separation member. For this liquid cartridge, given the length of each of paths from the gas-liquid separation member to the atmosphere communication port as Ln, and the sectional area of each as Sn, the diffusion resistance R is $R=\Sigma(Ln/Sn)$, and the coefficient K calculated on the basis of the liquid evaporation rate not allowing component contained in the liquid to be solidified around the liquid discharge port, the diffusion resistance R, and the amount of liquid evaporation is $K=10{,}000$ ($mg.mm/mm^2$). Then, given the total weight of liquid filled in the liquid storing chamber as V, the following expression is satisfied: $K/V<R<2{,}000$.

For the liquid discharge cartridge of the present invention, it is arranged to set the diffusion resistance R to be $K/V<R$, provided that the coefficient K, which is calculated on the basis of the liquid evaporation rate not allowing the component contained in liquid to be solidified around the liquid discharge port, the diffusion resistance R, and the amount of liquid evaporation, is $K=10{,}000$ ($mg.mm/mm^2$). Then, the length Ln of each of paths from the gas-liquid separation member to the atmosphere communication port, and the sectional area Sn of each path of the liquid discharge cartridge are set so as to enable the diffusion-resistance R to take the aforesaid value, thus suppressing the amount of liquid evaporation. In this way, it becomes possible to obtain excellent discharge condition where the component contained in liquid is not solidified around the liquid discharge port due to the density of liquid that is made too high, that is, the ink dyestuffs are not caused to be solidified around the discharge port.

Also, as a result of studies made by the inventors hereof, it becomes apparent that the pit-in time increases abruptly when the diffusion resistance R exceeds 2,000. Here, the liquid discharge cartridge of the present invention is structured so that the diffusion resistance R is kept within a range of $R<2{,}000$. Hence, there is no possibility, either, that the pit-in time increases.

DETAILED DESCRIPTION OF THE PREFERRED EMBODIMENTS

Next, with reference to the accompanying drawings, the embodiments will be described in accordance with the present invention. Here, it is to be understood that the numeral value shown in each of the embodiments is one example, and the present invention is not necessarily limited thereto.

(First Embodiment)

Figure 1A:
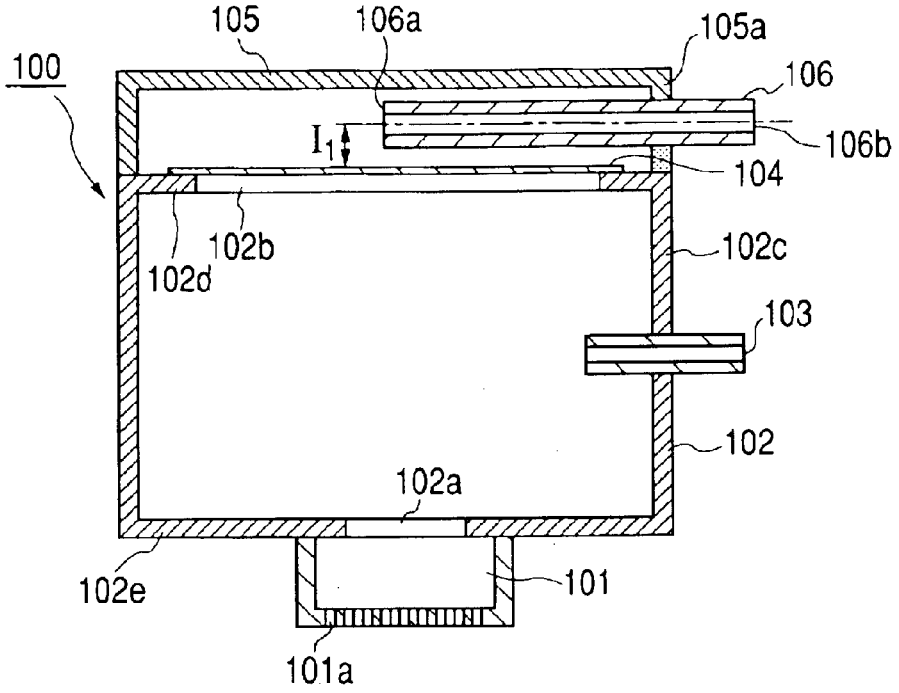
FIGS. 1A and 1B are side sectional view and plan sectional view that illustrate an ink jet cartridge in accordance with a first embodiment of the present invention.
Figure 1B:
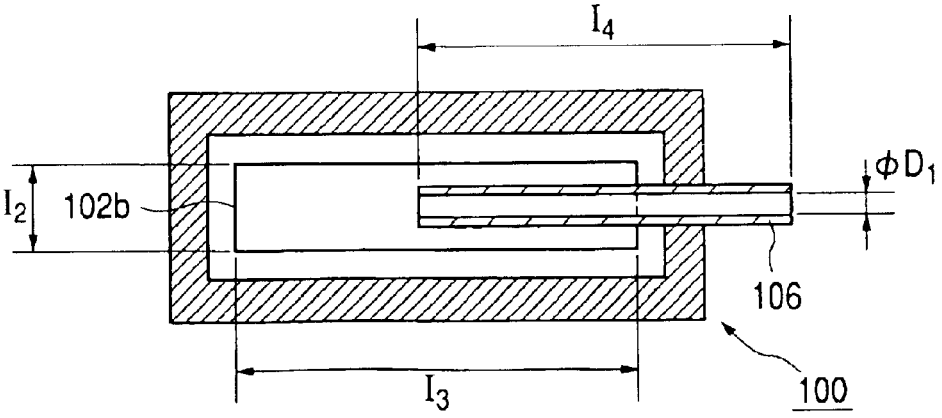

FIG. 1A is a side view of an ink jet cartridge in accordance with a first embodiment of the present invention, and FIG. 1B is a top sectional view thereof, respectively. Here, in FIG. 1B, the gas-liquid separation member is omitted in order to indicate the dimension of each part.

The ink jet cartridge 100 of the present embodiment is provided with a liquid storing chamber that stores ink therein; a covering member 105 having an atmosphere communication tube 106 for enabling the inside of the liquid storing chamber 102 to be communicated with the air outside; a recording head 101 having plural ink discharge ports 101*a* formed therefore in order to discharge ink; and a gas-liquid separation member 104 that functions as a full tank valve.

On the side face 102*c* of the liquid storing chamber 102, a liquid supply port 103 is provided in order to supply ink from a main tank (not shown). On the upper face 102*d* thereof, a communicating section 102*b* is formed, and then, the gas-liquid separation member 104 is installed to cover this communicating section 102*b*. Also, on the lower face 102*e* of the liquid storing chamber 102, a liquid supply path 102*a* is formed to supply ink to the recording head 101.

The covering member 105 is installed on the upper face 102*d* of the liquid storing chamber 102 to cover further the communicating member 102*b* that covers the gas-liquid separation member 104. The atmosphere communication tube 106 installed on the side face 105*a* of the covering member 105 is formed by a hollow cylindrical member, and the first end portion 106*a* thereof is positioned almost in the central part of the gas-liquid separation member 104, while the second end portion 106*b* is installed to extrude from the side face 105*a* of the covering member 105.

The gas-liquid separation member 104 is the porous material, which is formed by PTFE (polytetra fluoroethylene) or the like that allows gas to permeate, but cuts off the permeation of liquid, such as ink.

The recording head 101 that records by discharging ink to a recording material is provided with heaters serving as discharge energy generating means formed in the plural nozzles (not shown), which are communicated with the ink discharge ports 101*a,* respectively. Ink, which is in contact with each heater, generates change of states accompanied by abrupt voluminal changes (that is, generation of bubble) by the input of electrical energy into each heater. Ink is discharged from the ink discharge port 101*a* by active force resulting from such change of states of ink thus generated for the formation of images on the recording material.

Figure 2:
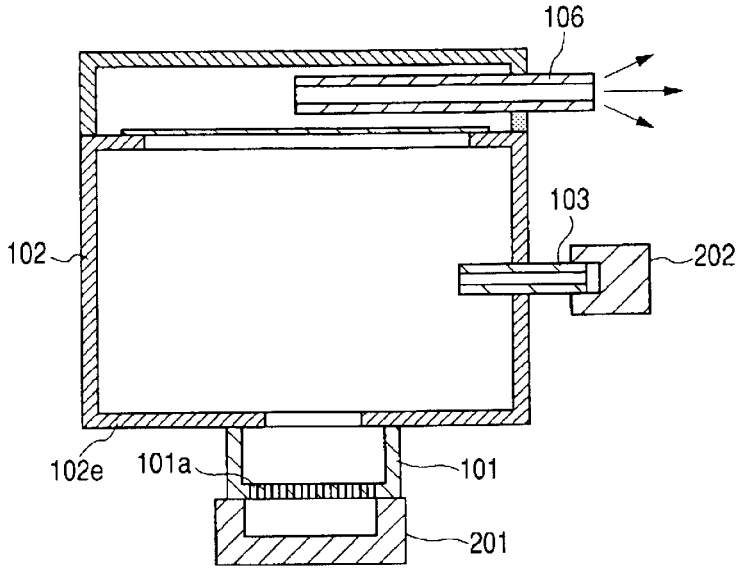
FIG. 2 is a cross-sectional view that shows the ink jet cartridge of the first embodiment of the invention when the cartridge is not in use.

FIG. 2 is a cross-sectional view that shows the ink jet cartridge of the present embodiment, which is not in use.

The ink discharge port 101*a* of the recording head 101 is covered by a cap 201 for use of the ink discharge port, and the liquid supply port 103 is covered by a cap 202 for use of the liquid supply port. On the other hand, the atmosphere communication tube 106 is released to the air outside in order to ease the expansion and the contraction of bubble in the liquid storing chamber 102 due to environmental temperature changes. In such status, the head is kept when it is not in use. However, ink in the liquid storing chamber 102 is evaporated from the atmosphere communication tube 106 as indicated by arrow marks. With the advancement of ink evaporation in the liquid storing chamber 102, moisture in ink is evaporated. The concentration of dyestuffs is made high and the resultant images become darker than originally anticipated, thus degrading the image quality. Also, as the evaporation further advances, ink round the nozzle portion becomes overly viscous or dyestuffs are solidified around the nozzle portion, thus making it impossible to refresh ink around the nozzle portion even when the suction recovery operation is executed. Then, the discharge direction is twisted or disabled discharge takes place to deteriorate the discharge characteristics.

Therefore, in accordance with the present embodiment, the atmosphere communication tube 106 is formed by the cylindrical member as described above so as to make the diffusion resistance component higher in the path from the gas-liquid separation member 104 to the second end portion 106*b* of the gas-liquid communication tube 106, hence making it possible to suppress the amount of evaporation from the atmosphere communication tube 106.

Hereunder, the specific numeral values of the atmosphere communication tube 106 and others of the ink jet cartridge 100 of the present embodiment are shown (see FIGS. 1A and 1B).

From the gas-liquid separation member to the atmosphere communication tube:

Distance $I_1$=0.5 (mm)

Area of communicating section $I_2 \times I_3$=3.0 (mm)×6.5 (mm)

Atmosphere communication tube:

Inner diameter $\phi D_1 = \phi 0.25$ (mm)

Length $I_4$=10 (mm)

With the values thus defined, the amount of ink movement Q in the path from the gas-liquid separation member to the atmosphere communication port in this mode is given as follows, provided that the amount of movement per unit time is given as W, and the time, as t:

$$W=Q/t=vu(S/L)$$

v: diffusion coefficient ($mm^2$/year)

u: block concentration difference ($mg/mm^3$)

S: sectional area ($mm^2$)

L: length (mm)

Also, given the diffusion resistance as R, it is as follows:

$$R=\Sigma(Ln/Sn)$$

Thus, $$R=0.5/(3.0\times6.5)+10/(0.25^2\times n/4)=204$$

Also, the full tank capacity of the liquid storing chamber 102 of the present embodiment is 120 (mg). However, the ink capacity becomes 110.5 (mg) when it is kept in storage for a period equivalent to one year at a temperature of 25° C. in full tank condition. The present embodiment is in a mode that there is almost no evaporation from the framed bodies, such as the liquid storing chamber 102 and the covering member 105. Therefore, it is assumed that ink of 9.5 (mg) is evaporated from the atmosphere communication tube 106. Hence, $$W=Q/t=vu(S/L)=-vu/R$$

$$9.5=vu/204$$

$$vu=9.5\times204$$

$$=1{,}938$$

Also, the block concentration difference u($mg/mm^3$) is considered to be 1. Therefore, the v=1,938 ($mm^2$/year).

Table 1 shows the solidifying condition of dyestuffs around the nozzle portion altogether when the evaporation rates are changed with respect to ink in the liquid storing chamber 102.

Table 1

| Evaporation rates | 5% | 10% | 15% | 20% | 25% | 30% |
|---|---|---|---|---|---|---|
| Solidification of dyestuffs around nozzle portion | ○ | ○ | ○ | ○ | x | x |

Here, the mark ○ indicates no solidification thereof, and the mark × indicates the generation of dyestuffs solidification, and ink in the nozzle portion is not refreshed even when the suction recovery operation is executed.

As shown in Table 1, when the evaporation rate is 20% or less, the solidification of dyestuffs does not occur, but when it becomes 25% or more, the solidification thereof takes place.

With respect to the liquid storing chamber 102 of the present embodiment, ink of 9.5 (mg) is evaporated from the atmosphere communication tube 106. This corresponds to 7.9% when ink is fully filled in the tank, and at the time of storage for a period equivalent to one year at a temperature of 25° C., there is no ink, which has become overly viscous around the nozzle portion or no solidification of dyestuffs around the nozzle portion, hence making it possible to obtain excellent discharge condition. Also, it becomes possible to suppress the increase of density of ink dyestuffs, and there is no degradation of image quality.

Here, in order to control the amount of ink evaporation to be 20% or less when stored for a period equivalent to one year at a temperature of 25° C., the following relations should be taken into consideration, provided that the ink capacity at the time of full tank is given as V:

$$1{,}938/R<V\times0.2$$

$$R>9{,}690/V$$

Then, including the margin for designing, the following expression is satisfied:

$$R>10{,}000/V \quad (1)$$

Also, if the numeral 10,000 in the expression (1) is assigned to the coefficient K (mg.mm/mm$^2$), $$R>K/V$$

Then, the ink capacity 120 (mg) at the time of full tank in accordance with the present embodiment is assigned to the aforesaid expression, it becomes as follows:

$$\text{the } R>10{,}000/120>83.3$$

Thus, the R=204 in accordance with the present embodiment, and it is readily understandable that the expression is satisfied.

Figure 3:
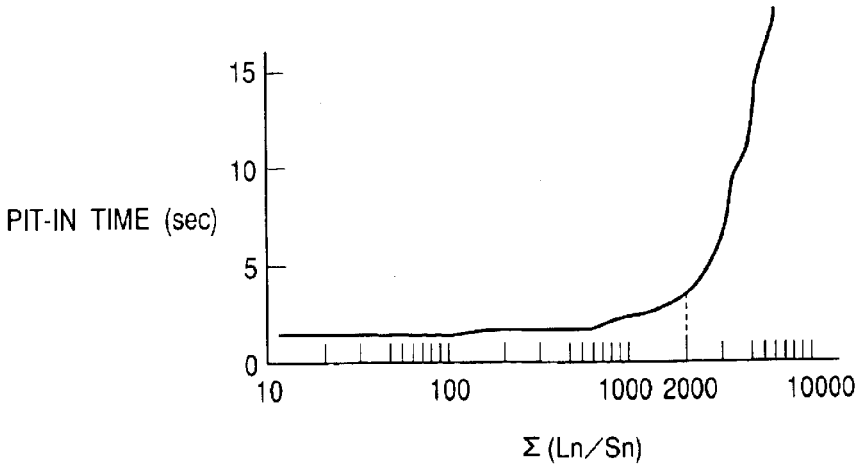
FIG. 3 is a graph that shows the time required for executing the pit-in supply of ink when $\Sigma(Ln/Sn)$ changes.

Next, FIG. 3 is a graph that shows the ink pit-in supply time when the R=Σ(Ln/Sn) is changed.

As understandable from FIG. 3, if the value of R=Σ(Ln/Sn) exceeds 2,000, the pit-in time increases abruptly. The increase of the pit-in time results directly in the increase of recording time as it is, and it invites the slow down of recording speed. Also, the increase of the pit-in time leads to the increase of the time taken by the gas-liquid separation member. Thus, there is a fear that the pit-in durability is lowered. Therefore, with the arrangement to make $$R<2{,}000 \quad (2)$$

the pit-in ink supply can be executed quickly and stably.

Here, in accordance with the present embodiment, the pit-in supply is executed by the five-second suction at 20.3 (kPa).

As described above, given the length of each of the paths from the gas-liquid separation member to the atmosphere communication port as Ln; the sectional area of each path as Sn; the diffusion resistance R as R=Σ(Ln/Sn); the coefficient K as K=10,000 (mg.mm/mm$^2$); and the total weight of liquid filled in the liquid storing container as V for the ink jet cartridge of the present embodiment, the following expression is satisfied:

$$K/V<R<2{,}000$$

With the arrangement to set the length of each path of the paths from the gas-liquid separation member of the liquid discharge cartridge to the atmosphere communication port to be the Ln, and the sectional area of each path to be the Sn so that the diffusion resistance R becomes as indicated above, it is made possible to suppress the amount of liquid evaporation. In this manner, the density of ink is not allowed to be too high to cause the solidification of ink dyestuffs around the nozzle portion, hence obtaining excellent discharge condition. Also, the diffusion resistance R is made to be within the range of R<2,000. Then, there is no possibility that the pit-in time increases. The degradation of image quality and the deterioration of discharge characteristics are also reduced. In this way, it is possible to provide an ink cartridge capable of executing the pit-in supply quickly and stably.

In accordance with the present embodiment, a needle type member having the inner diameter of D=ϕ0.25 (mm) and the length L=10 (mm) is uses as the atmosphere communication tube in order to increase the diffusion resistance in the path from the gas-liquid separation member to the atmosphere communication port. Here, it is to be understood that any other structures formed in some other way but used for increasing the diffusion resistance component conforms to the present invention. As one example therefor, the ink cartridge, which is provided with a covering member having a labyrinth structure to increase resistance component, is of course within the range of the present invention.

(Second Embodiment)

Figure 4A:
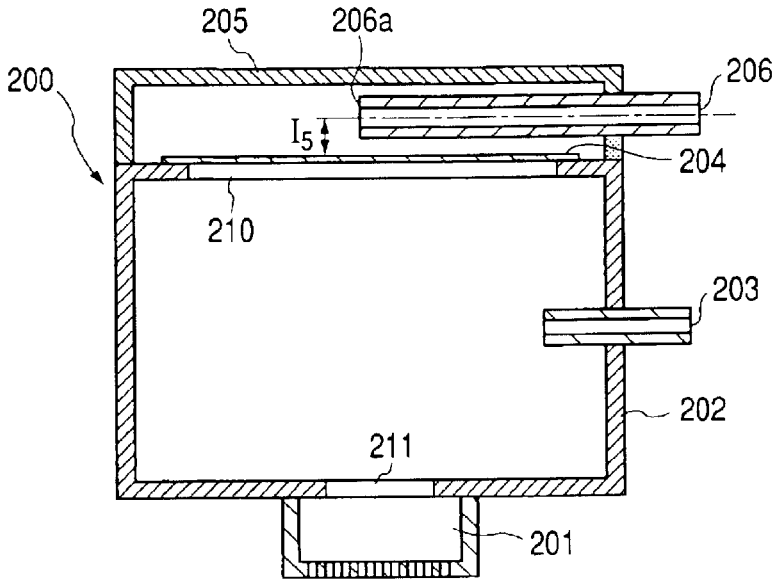
FIGS. 4A and 4B are side sectional view and plan sectional view that illustrate an ink jet cartridge in accordance with a second embodiment of the present invention.
Figure 4B:
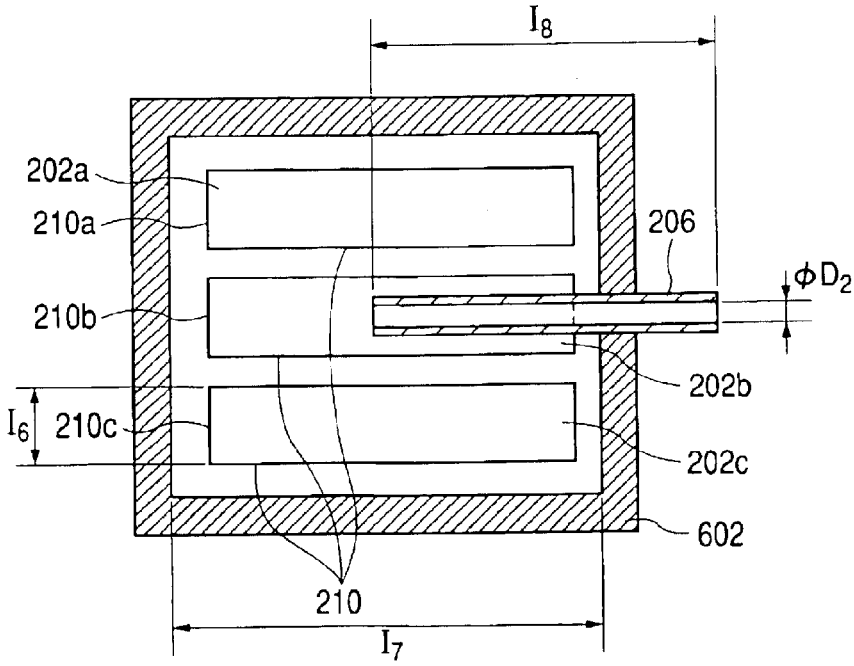

FIG. 4A is a side sectional view that shows an ink jet cartridge in accordance with a second embodiment of the present invention, and FIG. 4B is a plan sectional view thereof, respectively. Here, in FIG. 4B, the gas-liquid separation member is omitted in order to indicate the dimension of each portion.

The ink jet cartridge 200 of the present embodiment is structured to contain three ink storing chambers 202 in parallel for use of yellow ink, magenta ink, and cyan ink, respectively, and the communicating sections 210*a,* 210*b,* and 210*c* are formed corresponding to each of the liquid storing chambers 202*a,* 202*b,* and 202*c.* Also, three liquid supply paths 211 (not shown) for supplying ink in each of the liquid storing chambers 202*a,* 202*b,* and 202*c* to the recording head 201 are formed corresponding to each of the liquid storing chamber 202*a,* 202*b,* and 202*c.*

An atmosphere communication tube 206 is installed on a covering member 205 in such a manner that the first end portion 206*a* thereof is positioned above the liquid storing chamber 202*b,* which is arranged in the middle of the liquid storing chambers 202*a,* 202*b,* and 202*c* installed in parallel.

In this respect, the fundamental structure other than those described above is the same as that of the ink jet cartridge described in accordance with the first embodiment. Therefore, the detailed description thereof will be omitted.

Next, the specific numeral values in the path from the gas-liquid separation member to the atmosphere communication port are shown for the present embodiment (see FIGS. 4A and 4B).

From the gas-liquid communication member to the atmosphere communication tube:

Distance $I_5$=0.5 (mm)

Area of communicating section $I_6 \times I_7$=(2.7 (mm)×3)×6.5 (mm)

Atmosphere communication tube:

Inner diameter $\phi D_2$=ϕ0.25 (mm)

Length $I_8$=10 (mm)

Consequently, the diffusion resistance R in the path from the gas-liquid separation member to the atmosphere communication port in this mode is as follows:

$$R=\Sigma(Ln/Sn)=0.5/(2.7\times3\times6.5)+10/(0.25^2\times n/4)=204$$

For the present embodiment, the capacity at the time of ink full tank is 120 (mg) in each of the liquid storing chambers, and the total of three colors is 360 (mg).

Here, given the total weight of liquid filled in the liquid storing chamber shown for the first embodiment as V, $$R>10{,}000/V \quad (1)$$

Then, the aforesaid numeral value is assigned thereto, it is made as follows:

$$R>10{,}000/360>27.8$$

Thus, for the present embodiment, too, it is confirmed that the above expression is satisfied. Also, it is understandable that $$R<2{,}000 \quad (2)$$

is satisfied.

For the present embodiment, too, given the length of each of the paths from the gas=liquid separation member to the atmosphere communication port as Ln; the sectional area of each path as Sn; the diffusion resistance R as $R=\Sigma(Ln/Sn)$; the coefficient K as K=10,000 (mg.mm/mm$^2$); and the total weight of liquid filled in the liquid storing container as V for the ink jet cartridge of the present embodiment, the following expression is satisfied:

$$K/V<R<2{,}000$$

Thus, as in the first embodiment, it is possible to provide an ink cartridge capable of reducing the possibility that the image quality is degraded and the discharge characteristics are deteriorated, while being capable of executing the pit-in supply quickly and stably.

So far, one example of the ink jet cartridge of the present invention has been described in detail. However, the present invention is not limited thereto.

Now that the length Ln of each of the paths from the gas-liquid separation member to the atmosphere communication port, and the sectional area Sn of each path are defined for the ink jet cartridge so that the diffusion resistance R becomes a numeral value within a range of $K/V<R<2{,}000$ when the coefficient K is equal to 10,000 (mg.mm/mm$^2$), it is possible to obtain excellent discharge condition by suppressing the amount of evaporation of liquid from the atmosphere communication port without increasing the pit-in time (that is, quick ink supply is possible at high speed without causing the ink supply speed to be lowered). Thus, a recording head structure provided with ink reservoir section can be provided, which is arranged to reduce the degradation of image quality and the deterioration of discharge characteristics.

What is claimed is:

1. A liquid discharge cartridge comprising:

a recording head provided with a liquid discharge port for discharging liquid;

at least one liquid storing chamber for storing liquid to be supplied to said recording head;

a gas-liquid separation member arranged for an opening portion of said liquid storing chamber; and an atmosphere communication port for enabling the inside of said liquid storing chamber to be communicated with the air outside through said gas-liquid separation member, wherein given the length of each of paths from said gas-liquid separation member to said atmosphere communication port as Ln, and the sectional area of each path as Sn, the diffusion resistance R is $$R=\Sigma(Ln/Sn)$$

then, the coefficient K calculated on the basis of the liquid evaporation rate not allowing component contained in said liquid to be solidified around said liquid discharge port, said diffusion resistance R, and the amount of liquid evaporation is $$K=10{,}000\ (\text{mg.mm/mm}^2)$$

given the total weight of liquid filled in said liquid storing chamber as V, the following expression is satisfied:

$$K/V<R<2{,}000.$$

* * * * *